US005807456A

United States Patent [19]

Kaule

[11] Patent Number: 5,807,456

[45] Date of Patent: Sep. 15, 1998

[54] METHOD FOR PRODUCING METALLIC PLANAR ELEMENTS ON SUBSTRATES

[75] Inventor: Wittich Kaule, Emmering, Germany

[73] Assignee: GAO Gesellschaft Fur Automation und Organisation, Munich, Germany

[21] Appl. No.: 767,599

[22] Filed: Dec. 2, 1996

Related U.S. Application Data

[63] Continuation of Ser. No. 42,041, Apr. 1, 1993, abandoned.

[30] Foreign Application Priority Data

Apr. 3, 1992 [DE] Germany ..... 42 11 235.4

[51] Int. Cl.[6] ..... B44C 1/165

[52] U.S. Cl. ..... 156/230; 156/219; 156/231; 156/238; 156/239; 156/240

[58] Field of Search ..... 156/230, 231, 156/233, 234, 235, 238, 239, 240, 58, 219, 220, 320, 330; 428/914, 915, 916

[56] References Cited

U.S. PATENT DOCUMENTS

| | | | |
|---|---|---|---|
| 3,009,847 | 11/1961 | Alles et al. | 156/231 X |
| 3,565,978 | 2/1971 | Folger | 264/1.3 X |
| 3,922,416 | 11/1975 | Ryan | 428/172 X |
| 4,006,050 | 2/1977 | Hurst | 156/234 X |
| 4,339,168 | 7/1982 | Haines . | |
| 4,344,998 | 8/1982 | de Leeuw | 428/212 X |
| 4,420,515 | 12/1983 | Amon | 428/49 X |
| 4,455,359 | 6/1984 | Patzold | 430/10 X |
| 4,614,367 | 9/1986 | Breen | 283/102 X |
| 4,631,222 | 12/1986 | Sander | 428/172 X |
| 4,631,223 | 12/1986 | Sander | 428/172 X |
| 4,664,734 | 5/1987 | Okita et al. | 156/231 |
| 4,725,111 | 2/1988 | Weitzen | 350/3.85 |
| 4,728,377 | 3/1988 | Gallagher | 156/58 X |
| 4,758,296 | 7/1988 | McGrew | 156/231 X |
| 4,840,757 | 6/1989 | Blenkhorn | 282/22 X |
| 4,852,911 | 8/1989 | Hoppe | 283/82 X |
| 4,856,857 | 8/1989 | Takeuchi | 350/3.6 X |
| 4,889,366 | 12/1989 | Fabbiani | 286/86 X |
| 4,913,858 | 4/1990 | Miekka | 264/1.3 X |
| 5,104,471 | 4/1992 | Antes | 156/233 X |
| 5,238,516 | 8/1993 | Van Suylekom | 156/230 |
| 5,267,755 | 12/1993 | Yamauchi | 283/86 X |
| 5,300,169 | 4/1994 | Tahara . | |
| 5,319,475 | 6/1994 | Kay | 359/2 X |

FOREIGN PATENT DOCUMENTS

| | | |
|---|---|---|
| 0 145 481 | 12/1984 | European Pat. Off. . |
| 2181993 | 5/1987 | United Kingdom . |

OTHER PUBLICATIONS

G. Saxby, "The Business of Embossing", *The British Journal of Photography,* vol. 137, No. 6757, 22 Feb. 1990, London, GB, pp. 20–21.

*Primary Examiner*—David A. Simmons
*Assistant Examiner*—Paul M. Rivard
*Attorney, Agent, or Firm*—Bacon & Thomas,PLLC

[57] ABSTRACT

A new method for producing substrates with a defined metallic surface form is provided which can be used advantageously in particular for producing reflection holograms on papers of value. The metallic planar elements are produced in detachable form on a master, e.g. a press roll, and then transferred directly from the master to the particular substrate.

45 Claims, 7 Drawing Sheets

1
2
3
4
5
6
7
8
9

METHOD FOR PRODUCING METALLIC PLANAR ELEMENTS ON SUBSTRATES

This application is a Continuation of application Ser. No. 08/042,041, filed Apr. 1, 1993, now abandoned.

BACKGROUND OF THE INVENTION

1. Field of the Invention

The present invention relates to a method and an apparatus for producing locally limited metal layers on substrates possibly having a rough surface by the transfer method wherein the metal layers are prepared on a transfer surface and then transferred to the substrate.

2. Related Technology

Metallic planar elements are of considerable importance in the field of antifalsification documents. Firstly, metallic surfaces offer good copy protection due to their reflection properties since the reflective surfaces cannot be recreated by copying technology. In the simplest case metal printing inks are customarily used to produce planar or printed images with metallic luster. Due to the grainy fine structure, however, these methods can only be used for metallic surfaces which do not have to show high reflective behavior or any defined surface structures.

The highest demands on the metal surface are made in the production of metal-coated holograms, which are a very widespread type of protection from forgery today. Holograms can only be imitated with relatively high effort, if at all, due to their elaborate and expensive production, and offer good copy protection due to their optical properties dependent upon the viewing angle. Holograms are often applied to security documents not only for security reasons but also for esthetic reasons.

Reflection holograms are usually produced using specially prepared die-plates having a surface relief corresponding to the interference pattern of the hologram by embossing the surface relief into a hardened layer of lacquer and then metalizing and providing it with a layer of protective lacquer. Alternatively one can also emboss the relief on the die-plate directly into a thin metal layer and then provide the layer of protective lacquer. Metalization ensures sufficient brilliance of the hologram so that it is readily recognizable visually.

Various possibilities have been proposed for applying such metal layers or holograms in locally limited form to papers of value, bank notes or identity cards. One of the best perfected techniques, which is also used chiefly in applying holograms, is to prepare a separate hot-stamping band from which the hologram is transferred to the final carrier (DE-A 33 08 831, U.S. Pat. No. 4,758,296). The layers to be transferred are applied to a substrate provided with an easily detachable separation layer in reverse order to their later order on the document. The uppermost layer is an adhesive layer, for example a heat-sealing adhesive layer. This adhesive layer is used to interconnect the hot-stamping band and the document under the action of heat and pressure. The substrate of the hot-stamping band can then be effortlessly removed due to the separation layer.

Although the transfer band is produced as a continuous band, i.e. metalization takes place in a continuous process (e.g. in a vacuum deposition facility), only the desired plane areas are transferred to the document. The plane areas can be transferred in different ways. For example the adhesive layer can be printed on in a certain pattern so that the layer structure to be transferred adheres to the document only in certain places (possibly by large-surface heating), or the pressure stamp used for lamination has a contour shape corresponding to the shape to be transferred so that only the areas of the adhesive layer subjected to the pressure and heat of the press die are activated even if heat-sealing adhesive is applied over a large surface (DE-A 33 08 831).

However this hot-stamping transfer method is not fully suitable for applying holograms to bank notes. Since bank notes are printed by steel intaglio printing which requires a rough paper surface, the surface structure of the paper is normally embossed into the thin transfer layer. The surface roughness of the paper thus overlays the relief structure of the hologram, diffraction grid or the like, so that the hologram loses some of its sharpness and brilliance. This effect must be avoided by taking additional measures to glaze the bank note in the area of the hologram to be applied (EP-A 0 440 045).

Such additional measures can be avoided by providing the bank note paper with the layer of lacquer to be embossed in such a way that the layer of lacquer applied in the liquid state compensates the uneven areas of the bank note surface.

For example, EP-A 0 338 378 describes a continuous method wherein bank note paper in roll form is first printed on both sides and then provided with a holographic structure in certain areas. The lacquer to be embossed and the relief structure are transferred simultaneously to the paper by covering the surface structure of the press die with a radiation-curable lacquer. As soon as paper and press die are brought in contact the lacquer is cured by UV radiation or electron beam. The lacquer now adheres to the paper surface and has the holographic relief structure. In the next step this relief structure is metalized with the aid of masks in a vacuum deposition facility. To protect the thin metal layer and fine relief structure from abrasion and destruction the hologram area is provided with a protective layer in a further step.

A similar method is known from DE-A 25 55 215. In this case a thermoplastic layer is transferred from a hot-stamping film to the document by means of a heated die-plate, the optical markings being embossed into the thermoplastic layer simultaneously. The carrier substrate is removed only after embossing and the relief structure then metalized.

This procedure, i.e. first embossing and then metalizing, has the crucial disadvantage that the metal layer does not exactly reconstruct the contours of the fine relief structure but blurs them by different deposits on perpendicular or horizontal structural elements. This even holds in cases in which the metal layer to be deposited is only a few nanometers thick. The hologram therefore likewise loses some of its brilliance.

The alternative procedure of embossing only after metalizing is likewise prior art. U.S. Pat. No. 4,420,515 discloses for example a method in which an already metalized lacquer surface is provided with a relief structure. An endlessly circulating transfer band is continuously metalized and brought in contact with a document that has been coated selectively with a lacquer. The lacquer is hardened and binds the metal to a greater extent than the transfer band, thus removing the metalization partially from the transfer band when transfer band and document are separated. In a last step the metalized lacquer area located on the substrate is provided with an embossing.

Since embossing is performed in the hardened layer of lacquer the embossed relief has low contour acuity. The quality of the hologram is thus impaired in this method as well. Also, the embossing must be performed at high pressure so that the die-plates are subject to high wear.

The invention is therefore based on the problem of providing a method and an apparatus for applying possibly locally limited metal layers to substrates while avoiding the abovementioned disadvantages. In particular the method and apparatus are to be suitable for flexible hologram production on difficult substrates and under difficult secondary conditions.

BRIEF SUMMARY OF THE INVENTION

The basic idea of the invention is that it is only possible to produce and transfer a surface structure i.e., pattern of form in optimal fashion if the forms to be transferred are taken from the master form with virtually no falsification and neither the form to be transferred nor the form of the master is changed or damaged during transfer to the final substrate.

The form to be transferred is thus prepared according to the invention not by embossing an existing plane metal layer but by "depositing" the metal layer on the master forms, whereby the metal layer precisely fills in and covers all structural elements of the master form like a cast. Master and metal layer thus have negative and positive forms which completely and precisely supplement each other and are intimately bonded together. To avoid changes or damage during transfer or during detachment of the metal layer from the master one separates the two structures only after the metal layer or form is fixed on the final substrate and mechanically stabilized by substrate and adhesive layer.

The term "structure" is intended very generally, i.e. a pattern of form that may be an extremely smooth reflective surface or any relief structure. For the invention it is important that the particular selected or given form be represented as a positive or negative form with virtually no falsification or distortion and transferred to the substrate with just as little falsification or distortion.

The term "layer of lacquer" includes all materials and substances that can be made so soft and sticky at the time of contact during transfer of the metal layer that the metal layer can be pressed with its back into the layer without damage. The metal layer thereby bonds intimately with the layer of lacquer and compensates all uneven areas between substrate surface and back metal surface, on the one hand, and adheres so firmly that it can be completely removed from the master, possibly after an additional hardening phase, on the other hand.

In practice this means that a 1:1 reproduction is effected directly on the master form by depositing the metal layer, a layer of lacquer is applied either to the metal layer or to the substrate that is sufficiently soft and sticky at the time when substrate and master are brought in contact, and the substrate is removed from the master together with the metal layer, the layer of lacquer being inherently stable to such an extent that it permits removal of the metal layer from the master and stabilizes the metal layer even after separation from the master such that the forms taken from the master are retained.

This ensures that the form present in the metal layer is stabilized by the master structure while being pressed onto the substrate until the layer of lacquer can take over this supporting function. This is followed by separation from the master and possibly further processing for further stabilization, protection from environmental influences, further design measures, etc. Such measures can be further hardening of the layer of lacquer, applying a layer of protective lacquer, providing blind stamps with different forms, overprinting with inks, etc.

Since no point-shaped mechanical forces act on the master form either during preparation of the metal layer or during transfer thereof, the production and transfer operations are extremely gentle both for the master form and for the form produced in the metal layer. Mechanical wear can be largely excluded during this production phase.

The carrier of the master form can be e.g. a cylindrical press roll, an endless band or a die, etc. The metal layer is produced using known metalization methods such as vacuum deposition, electrolysis or photolysis, and other special methods known in technology by names such as "gas jet deposition (GJD)," "spray deposition," "laser deposition," etc. The layer of lacquer can be hardened in different ways. For example it can be simply cooled if a liquid fusion adhesive is used, heated if multicomponent lacquers are used, or subjected to other energy, e.g. UV irradiation, microwave radiation, electron-beam curing, etc., if other substances are used.

The inventive method is particularly suitable for transferring locally limited metal layers since both the metalization and the transfer operation can be defined and structured in locally exact fashion.

As already explained, the metallic planar elements are produced on an intermediate carrier with the master structure or form from which they are transferred to the substrate. Unlike known methods in which the metalization is performed directly on the substrate itself, this procedure offers the advantage that any metalization methods can be used, including methods that would destroy or damage the substrate if there was direct application to the substrate.

It is particularly advantageous to perform metalization using photolytic methods, e.g. as described in DE-A 38 40 199 or DE-A 38 40 200, which offer the possibility of modifying the contour shapes of the metallic planar elements in particularly simple fashion. One can thus produce series of different planar elements or planar elements with varied additional information content in a particularly economic way.

The metalizing operation basically comprises the following steps:

conditioning the intermediate carrier, i.e. taking measures coordinated with the metalization method for selecting the areas of the intermediate carrier to be metalized, metalizing the intermediate carrier, transferring the local metal layers to the substrate, cleaning the intermediate carrier.

In the photolytic method the conditioning of the intermediate carrier (master) can be divided into individual steps, namely sensitizing the surface of the master with a catalyst or precursor, e.g. palladium acetate, optically activating the palladium acetate with UV radiation, and depositing metal in the sensitized and activated plane areas.

By selectively influencing one or more of these three steps one can obtain a manifold variation of the continuously prepared metal layers. For example one can sensitize the master in a locally limited way. All following working steps can then be performed over a large surface since metal deposition takes place only where the catalyst is present. Alternatively, one can perform large-surface sensitizing but then selective activation. This variant is particularly advantageous since very fine and sharply limited lines can be represented in this way using a controlled UV laser for example. These structures are retained in their fineness even if all-over wetting in wet-chemical baths is subsequently performed for currentless metalization. Finally, the local limitation of the metal layers can also be produced by applying the wet-chemical agents in defined fashion to a master surface sensitized and activated over a large surface.

If the form of the metal layers remains the same throughout several cycles one might dispense with repeated conditioning of the intermediate carrier, i.e. the intermediate carrier is not completely cleaned in the last step but only freed from metal remnants.

In the special case of applying hologram or diffraction structures the embossing roll is metal-coated according to the invention. This results in a further inventive aspect. The inventive method makes it possible for the first time to perform hologram production or embossing, metalization of the embossed hologram and transfer of the metalized hologram in one continuous process.

This is particularly advantageous when register problems hitherto had to be solved with subsequent application of the metalization, since all method steps and ranges of tolerance known from printing technology can be utilized in particular in cases in which a pressure cylinder serves as the intermediate carrier for master and metal layer. The inventive method also provides for the first time the possibility of including current data in the variation of the plane elements. This can be useful for example for papers of value, identity cards, etc., because serial numbers, personal alphanumeric or pictorial data (photo!) can be included in the preparation of the metal layer.

Along with these advantages and possibilities of design one also obtains an absolutely true reproduction of the master structure or form since the metal layer molds to the master form completely. As already mentioned, this is reflected advantageously in the optical quality of the hologram gram diffraction forms, etc.

BRIEF DESCRIPTION OF THE DRAWINGS

Further advantages and special embodiments of the invention will emerge from the following examples which are explained with reference to the Figures, in which FIGS. 1(*a*)–1(*d*) shows the basic inventive principle.

DETAILED DESCRIPTION OF PREFERRED EMBODIMENTS OF THE INVENTION

Figures 1A, 1B, 1C, 1D:
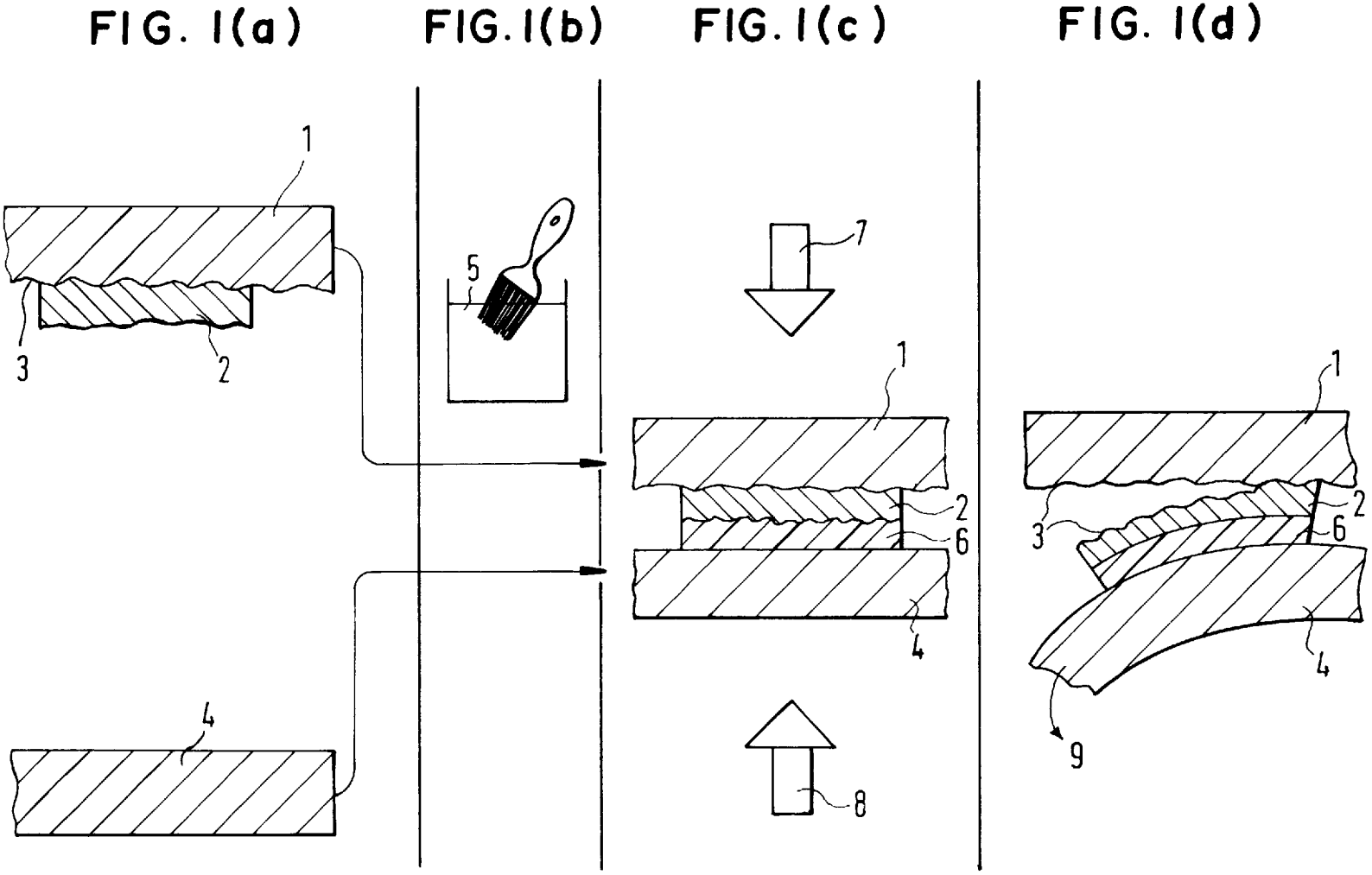

FIGS. 1(*a*)–1(*d*) show schematically the basic principle of the invention. According to this diagram master 1 is provided with a free metal layer 2 in a first unit (FIG. 1(*a*)). As already explained at the outset, master 1 has some kind of surface structure, pattern or form 3, in the shown case a surface relief. Metal layer 2 is applied to relief 3 in such a way that form 3 exists in metal free layer 2 as an exact negative structure. Metal layer 2 is preferably limited locally or has a defined contour.

In a second work unit (FIG. 1(*b*)) substrate 4 is prepared, which can be almost any kind of medium. In the present case it is a paper of value with a sized, naturally rough surface.

A lacquer coating means 5 is provided as a further work unit for applying a locally limited layer of lacquer 6 either to metal layer 2 or to substrate 4. The local limitation of the layer of lacquer preferably corresponds to that of metal layer 2. However it is also conceivable for the two contours to be different, whereby the metal layer must be removed from the master in defined fashion only in the areas where it is congruent with the layer of lacquer.

After lacquer coating, master 1, metal layer 2, layer of lacquer 6 and substrate 3 are brought together and pressed (FIG. 1(*c*)). Arrows 7, 8 symbolize the pressing power.

Depending on which lacquer is used, layer of lacquer 6 is to be hardened, possibly by additional measures, at least to such an extent as to ensure sufficient adhesion to metal layer 2 and substrate 4 and inherent strength permitting removal of the master with simultaneous stabilization of metal layer 2. Hardening can be performed most simply if layer of lacquer 6 is a heated fusion adhesive that solidifies relatively fast when master 1 and metal layer 2 are cooled after being brought together. However one can also use substances that harden under the action of IR or UV rays, microwaves, electron beams, etc. If the layer of lacquer has a consistency that permits both the layers to be pressed in and glued and the metal layer to be removed and stabilized without additional measures, the final hardening can also take place at a later time if desired.

In the last unit shown in FIG. 1(*d*), substrate 4 is removed from master 1 together with metal layer 2, e.g. in the direction of arrow 9. Depending on the later application, the metal layer transferred to the substrate in this way might be subjected to further working steps, e.g. provided with a transparent layer of protective lacquer. These further steps are familiar to the expert and need not be explained here.

The embodiment examples described in the following explain various ways of applying the inventive principle.

For the sake of vividness FIGS. 1(*a*)–1(*d*) and the further figures do not show true-to-scale or true-to-detail representations. They instead show fundamental arrangements which permit the inventive, method to be carried out. Functionally identical elements are provided with identical reference numbers in the figures.

EXAMPLE 1

Figure 2:
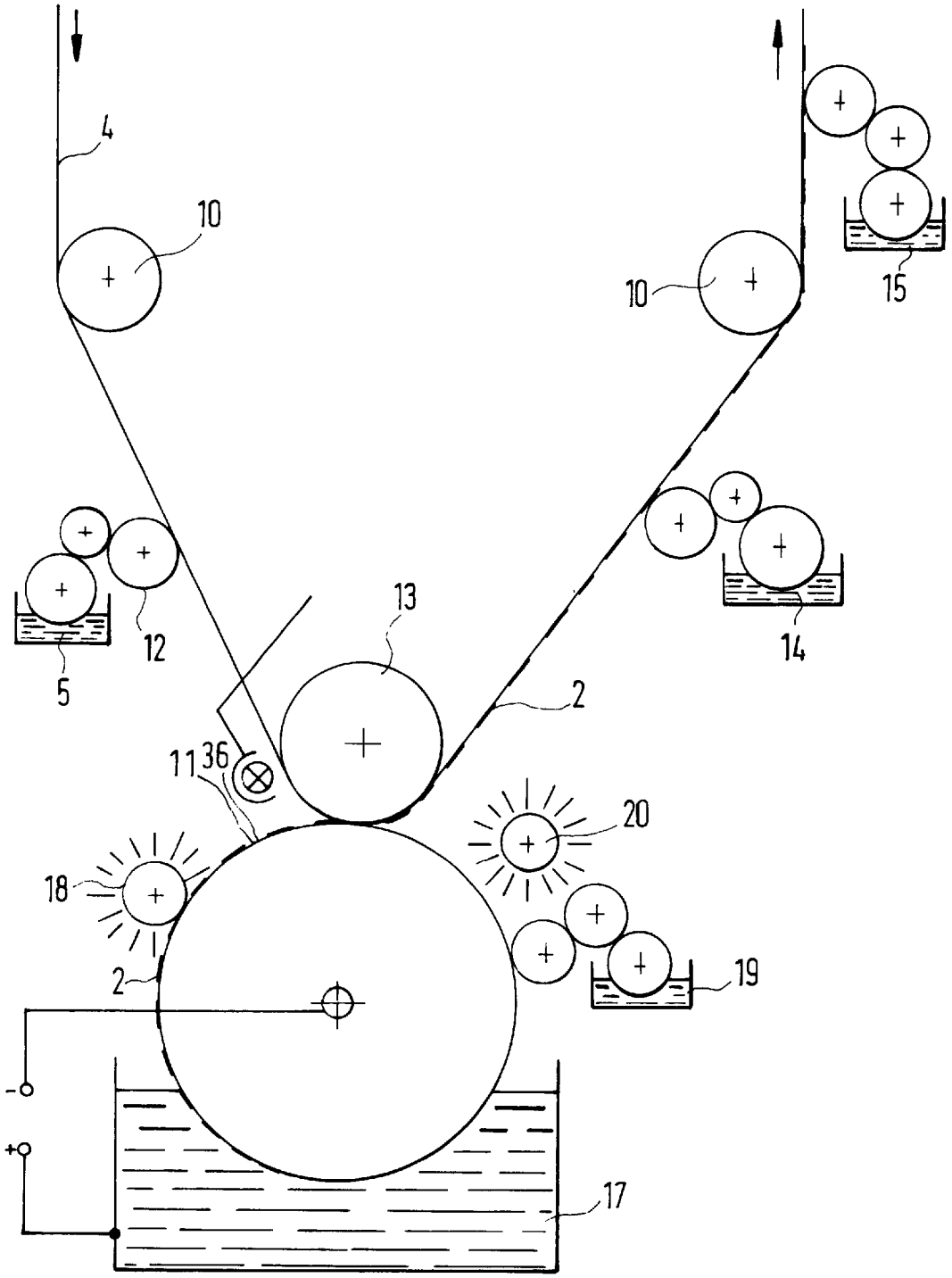
FIG. 2 shows electrolytic metalization of a cylindrical press roll or matrix and transfer of the metalization to a substrate.

In FIG. 2 a cylindrical press roll with a smooth surface face form is partially metalized electrolytically and brought in contact with an adhesive-coated substrate 4.

Substrate 4 in web form, in the present case paper, is conveyed by a transport system indicated in FIG. 2 by rolls 10. Before substrate web material 4 is fed to press roll 11 it passes through lacquer coating unit 5. Substrate web 4 is coated here in certain surface areas with a transparent adhesive using engraving or master cylinder 12.

Substrate 4 then passes through the transfer zone formed by cylindrical transfer roll 11 and likewise cylindrical back pressure roll 13. In the contact zone of coated substrate 4 and metalized transfer roll 11 the hardening of the adhesive can additionally take place, e.g. by polymerization with electron beams or UV irradiation. During further transport of web of material 4 metal coating 2 is removed from intermediate carrier 11. In further processing unit 14 metalized area 2, or the total area or large areas of web of material 4 if necessary, can be provided with a transparent layer of protective lacquer. Web of material 4 provided in this way with metallic planar elements 2 can finally be fed to further printing units 15 to be provided with alphanumeric characters or patterns that might also cover parts of metal coating 2. It is also conceivable to use, instead of conventional inks, special inks containing feature substances which may be transparent in the visual spectral range. Suitable feature substances are for example fluorescent substances, magnetic or lustrous pigments.

Figure 3:
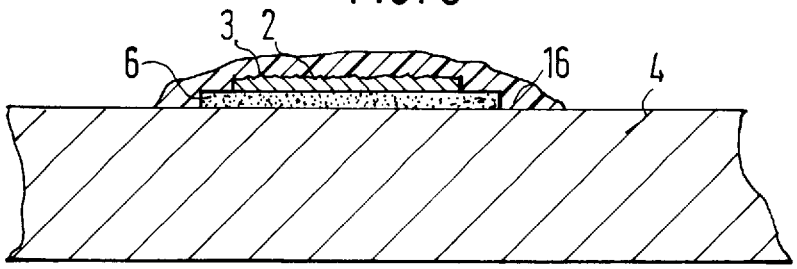
FIG. 3 shows the layer structure of the substrate after the metal transfer.

FIG. 3 shows the layer structure of metalized substrate 4 subsequent to protective lacquer coating unit 14. Adhesive layer 6 applied locally in unit 5 is disposed directly on substrate 4. Since layer 6 is transparent and very thin and therefore does not impair the visual impression of the final product, its areal extent need not correspond exactly to the dimensions of metalization 2. The extent of adhesive layer 6 must in any case not be smaller than metalization 2 provided because this would result in incomplete metal transfer. To protect metalization 2 from abrasion and destruction it is covered by likewise transparent layer of protective lacquer 16.

In the metalizing unit shown in FIG. 2 the intermediate carrier, here cylindrical roll 11, is provided with metallic planar elements 2 to be transferred, as already mentioned.

In this example transfer roll 11 is metalized electrolytically. The parts of the cylinder not to be metalized are coated in unit 19 with electrically insulating material, e.g. a layer of lacquer. In the next unit, regarded in the rotating direction of press roll 11, roll 11 passes through galvanic bath 17. The metal dissolved in the bath is deposited on the electrically conductive surface areas of roll 11 due to the voltage present on transfer cylinder 11 and the bath, giving rise to a metallic pattern on the roll surface. In subsequent washing unit 18 chemical residues are removed. Metal coating 2 is now transferred to substrate 4. Roll 11 is then cleaned of any metal remnants in unit 20. If the contours (or form) of the metal coating is to be changed the electrically insulating coating of roll 11 is likewise removed in cleaning unit 20. In lacquer coating unit 19 roll 11 is finally prepared for the next metalizing cycle.

EXAMPLE 2

Figure 4:
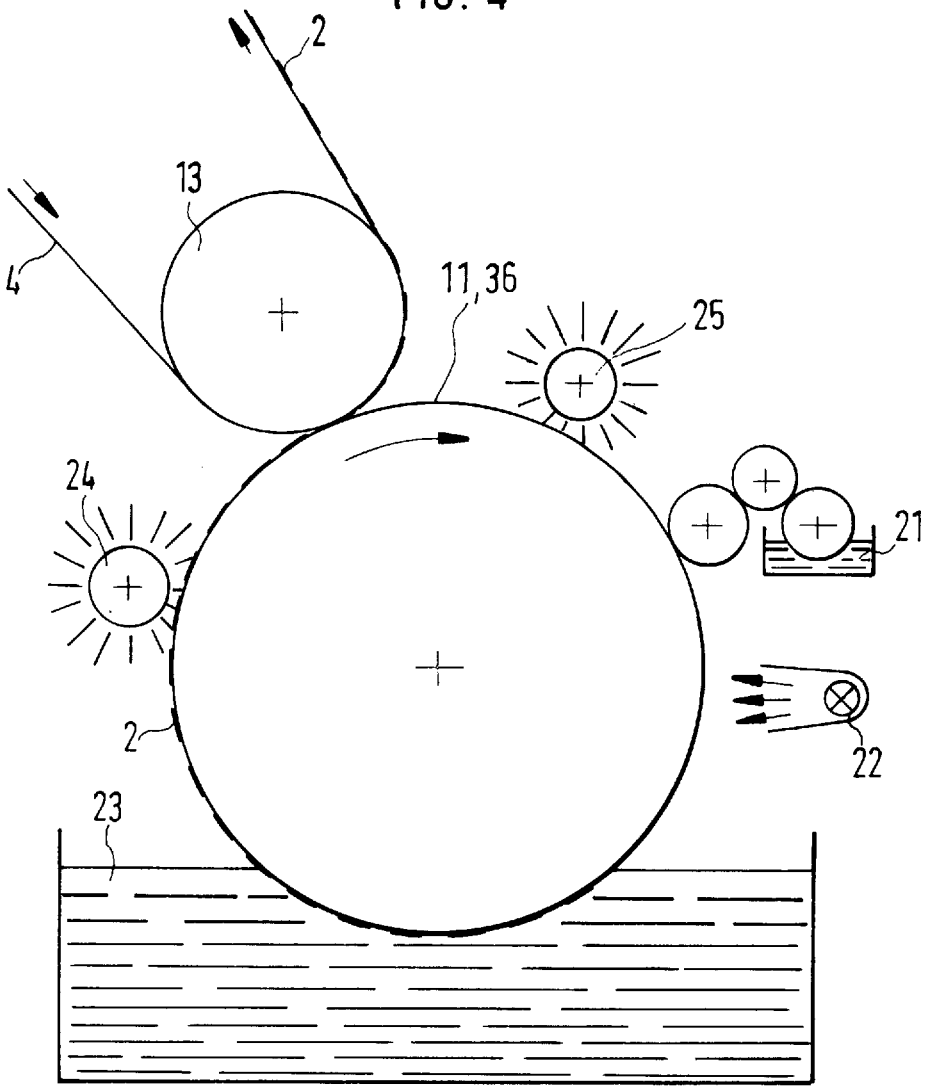
FIG. 4 shows photolytic metalization of a cylindrical press roll or matrix.

FIG. 4 shows a metalizing unit in which the abovementioned cylindrical transfer roll is partially metalized photolytically and brought in contact with an adhesive-coated substrate. The pre- and aftertreatment of substrate 4 and the transfer of the metallic areas are analogous to Example 1. The corresponding additional processing units are therefore omitted in FIG. 4.

Photolysis is a modern metalization method that has been used successfully for some years in metal-coating semiconductor components (DE-A 38 40 199) and in producing metal mat for shielding electric fields (DE-A 38 40 200).

At the beginning of the metalizing cycle intermediate carrier 11 is wetted with a palladium acetate film. For this purpose powdery palladium acetate is dissolved in a solvent, e.g. chloroform, and applied by immersion, spraying or centrifuging. FIG. 4 shows immersion unit 21 by way of example. The solvent evaporates immediately leaving a thin palladium acetate film whose thickness can be adjusted via the concentration of the solution and the applying operation. In unit 22 the parts of the press roll to be metalized are exposed to UV radiation to produce a thin palladium layer by selective photofission in the exposed places. This palladium layer which is only a few nanometers thick then serves as an activator for subsequent chemical metalization during which copper, nickel and gold layers with a thickness of micrometers can be applied. FIG. 4 shows metalizing bath 23 in which intermediate carrier roll 11 is dipped. In another variant the metalization can also be printed directly on intermediate carrier 11 using a suitable printing method, e.g. screen printing.

In cleaning unit 24 the palladium acetate residues not exposed and thus not metalized, and remains of liquid from metalizing bath 23 on roll 11, are rinsed off.

Since metal 2 is deposited exactly congruent to the activated or exposed places of the palladium acetate film, this method has the crucial advantage that any desired finely structured for formed surfaces, including ones differing in each exposure operation, can be metalized using sharply contoured and high-resolution exposure, e.g. a computer-controlled UV laser beam (e.g. excimer laser).

After metalization 2 is transferred to substrate 4, intermediate carrier 11 is cleaned in unit 25. The above-described procedure is thereafter repeated cyclically.

The finished substrate has the same layer structure in this example as in Example 1, which was described with reference to FIG. 3.

EXAMPLE 3

Figure 5:
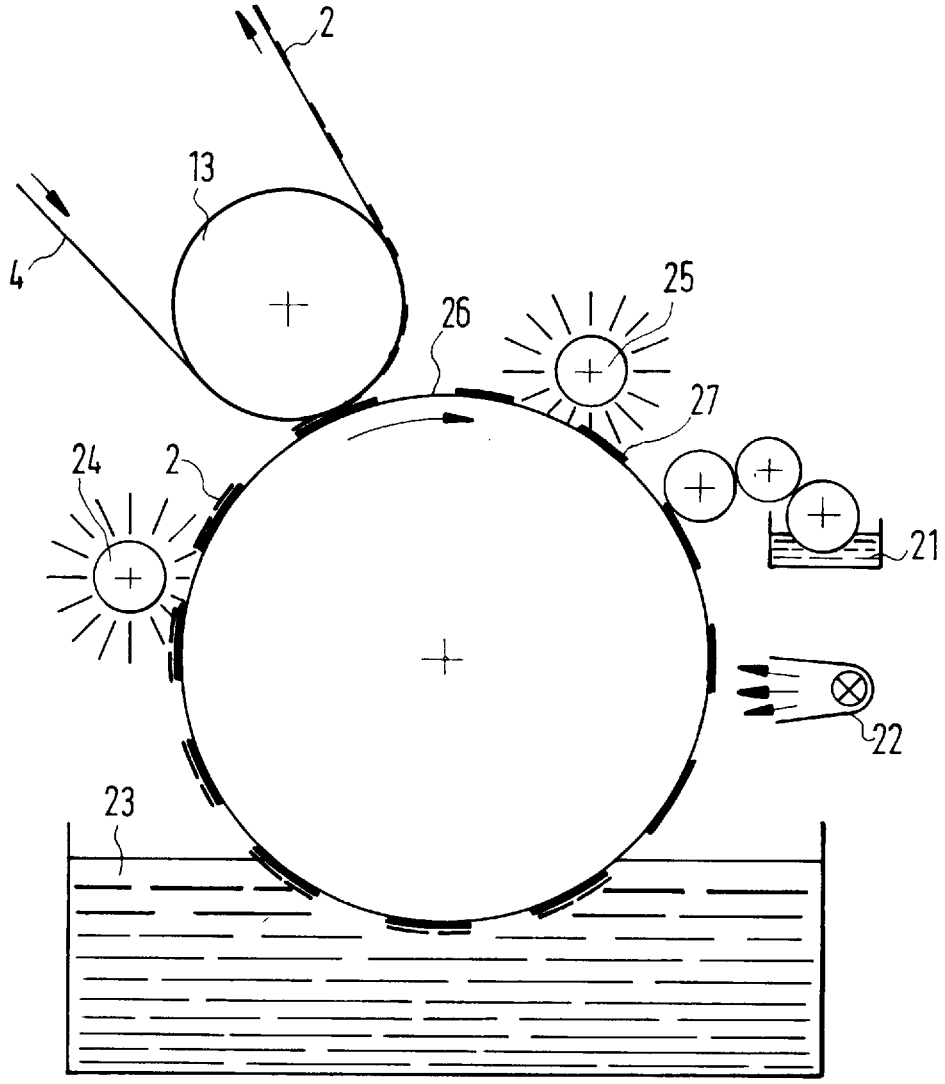
FIG. 5 shows photolytic metalization of a cylindrical letterpress roll and transfer of the metalization to a substrate.

Instead of a press roll with a smooth surface one can also use a cylindrical letterpress roll for example, as shown in FIG. 5. In the example shown this roll is likewise metalized by the photolytic method. The pre- and after-treatment of substrate 4 are again analogous to Example 1.

The method steps for metalizing letterpress roll 26 are analogous to Example 2. Raised areas 27 of press roll 26 are wetted with palladium acetate 21 and irradiated with UV light 22 over a large surface in accordance with the information to be transferred. The metal dissolved in metalizing bath 23 is deposited on the activated areas while the non-exposed areas are cleaned in cleaning unit 24.

In the contact zone between substrate 4 and raised printing areas 27 the adhesive previously applied to the substrate is hardened and thus binds metal layer 2 to substrate 4. Before the metalizing cycle begins again, printing areas 27 are cleaned completely in unit 25.

EXAMPLE 4

Figure 6:
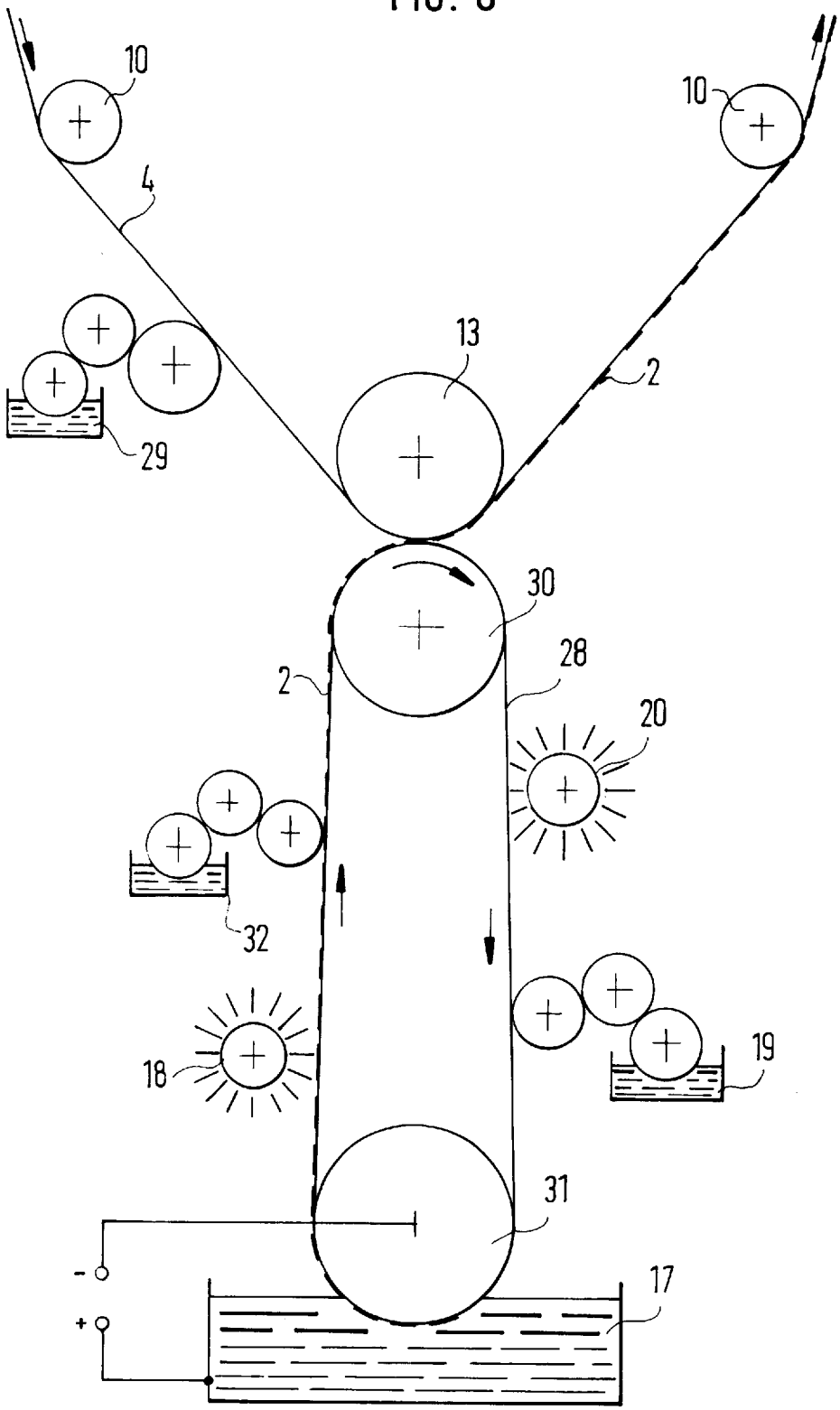
FIG. 6 shows electrolytic metalization of an endless printing or embossing band and transfer of the metalization to a substrate.

In this example, which is shown in FIG. 6, endless band 28 with a smooth surface serves as an intermediate carrier which is partially metalized electrolytically and brought in contact with adhesive-coated substrate 4.

However here the substrate is only coated locally with component 29 of the lacquer removing metal coating 2 from intermediate carrier 28. Substrate 4 is then transported through the transfer zone as in the preceding examples and possibly aftertreated in accordance with Example 1.

The metalizing unit comprises in this case endless band 28 circulating over rolls 30, 31 which is electrolytically metalized. In accordance with Example 1 endless band 28 is prepared in units 20 and 19 and then metalized locally in galvanic bath 17. After spurious bath residues are cleaned in unit 18 second component 32 of the detaching lacquer is applied to metalization 2, e.g. a bonding agent for the metal layer to be transferred and/or a hardener for the first component. Upon contact of the two components in the transfer zone the diffusion of the hardener together with the supply of energy, which must be coordinated with the particular substances used, causes accelerated hardening and a very good bond between the transferred metal layer and the substrate.

This two-component adhesive can of course also be used in all other examples described.

EXAMPLE 5

Figure 7:
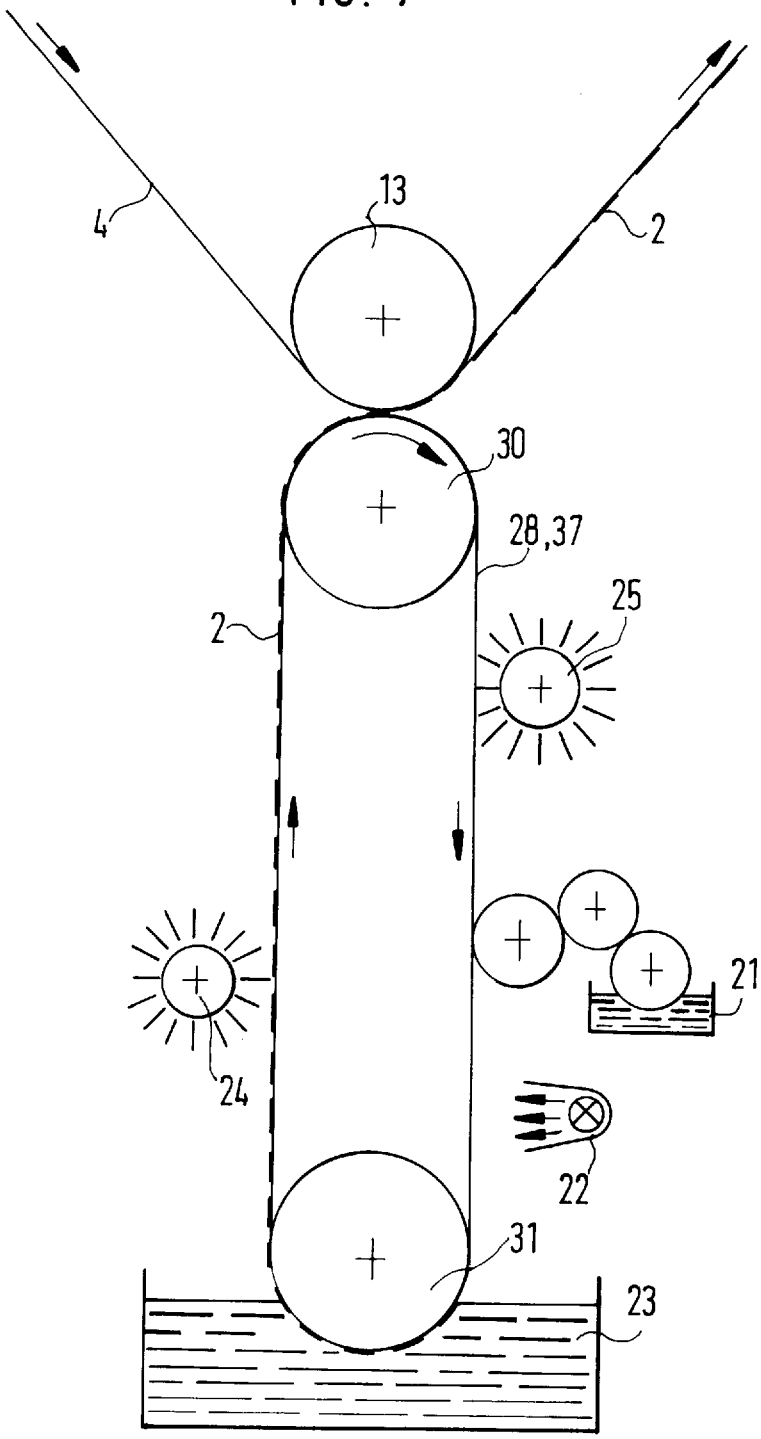
FIG. 7 shows photolytic metalization of an endless printing or embossing band.

A further variant of a metalizing unit is shown in FIG. 7. The pre- and aftertreatment of substrate 4 are analogous to Example 1. FIG. 7 therefore shows only the means necessary for metalizing endless band 28 and rolls 13 and 30 forming the transfer zone.

The partial metalization of intermediate carrier 28 is effected here by the photolytic method as in Example 2. Endless band 28 is wetted with palladium acetate film 21 which is activated by UV irradiation 22 in certain places for the metal deposition in metalizing bath 23. Units 24 and 25 ensure the cleaning of band 2 already described.

EXAMPLE 6

Figure 8:
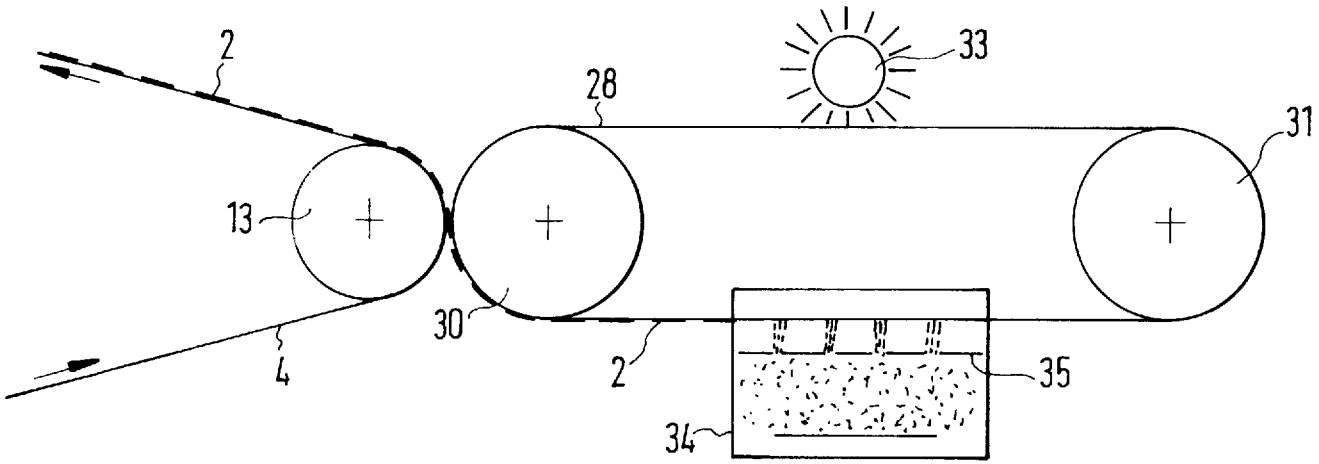
FIG. 8 shows metallic vacuum deposition on an endless printing or embossing band.

Since the pre- and aftertreatment of the substrate in this example again correspond to the preceding examples, the representation in FIG. 8 is likewise limited to the metalizing unit and the transfer zone. Endless band 28 serving as the intermediate carrier is partially metalized here by vacuum coating via masks.

Band 28 is cleaned of any metal remnants in unit 33 before each metalizing cycle. The conditioning of the areas to be coated takes place in vacuum chamber 34 itself, possibly using masks 35. The vacuum coating method can be vacuum deposition or cathode ray sputtering. The transfer of the metallic areas is effected, as already explained, by hardening or cooling the adhesive in the contact zone of substrate 4 and endless band 28 between rolls 13 and 30.

The methods for locally metalizing a substrate shown in FIGS. 2 to 8 and described in Examples 1 to 6 can also be used very advantageously for metalizing a diffraction structure, preferably a hologram. In this case the intermediate carrier is formed as a matrix, i.e. it bears on its surface the diffractive relief structure, pattern or form that is embossed into the lacquer on the substrate according to prior art. As already explained, the lacquer can alternatively be applied to the metalized areas of the intermediate carrier and transferred to the substrate simultaneously with the metal layer.

The inventive metalization of the insensitive matrix instead of the sensitive substrate makes it possible to perform chemical metalization with aggressive chemicals. The following examples describe metalizing units having such an intermediate carrier formed as a matrix.

Everything said about process control variants in connection with the above examples can be readily transferred to the following examples.

EXAMPLE 7

A cylindrical press roll with a relief surface structure pattern or form is electrolytically metalized partially or all over and brought in contact with an adhesive-coated substrate.

The apparatus shown in FIG. 2 can basically be used. Only cylindrical press roll 11 must have a relief surface corresponding to the hologram.

Substrate 4, e.g. a paper web, is preferably placed with engraving or master cylinder 12 and coated with lacquer 5 locally, i.e. in the places where the hologram is to be embossed. Substrate 4 is then transported into the embossing and metal transfer zone between pressure roll 13 and metalized matrix 36. Cylindrical matrix 36 has the embossed hologram form placed in exact register relative to the locally coated surfaces of substrate 4.

The surface relief of matrix 36 is metalized all over or partially by the electrolytic method already described in Example 1. Metalization can also be done all over because transfer in exact register is determined by the coated places on substrate 4. However, sharper contouring of metal surfaces 2 is obtained by partial metalization of matrix 36.

In the contact zone of coated substrate 4 and detachably metalized matrix 36 the relief form is transferred faithfully into the lacquer. The lacquer is simultaneously hardened e.g. by cooling, UV radiation or polymerization with electron beams. As in Example 1 the hardened layer of lacquer removes the metalization from matrix 36.

One can thus dispense with working steps in the hologram production because embossing and metalization of the relief form are performed simultaneously in one operation.

The other method steps are analogous to Example 1.

EXAMPLE 8

In the metalizing means described according to Example 2 and FIG. 4 cylindrical press roll 11 with a smooth surface is replaced by likewise cylindrical matrix 36 and metalized photolytically.

EXAMPLE 9 to 11

The metalizing means described in Examples 4 to 6 that use an endless band as an intermediate carrier can also be used for combined hologram embossing and metalization according to the Invention. In these cases endless band 28 bears the hologram relief form.

Figure 9:
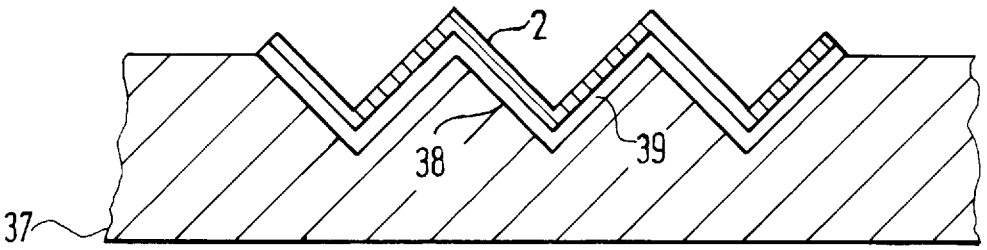
FIG. 9 shows the layer structure of a photolytically metalized embossing band.

FIG. 9 shows a portion of photolytically metalized embossing band 37 (FIG. 7) before it is brought in contact with substrate 4. Endless band 37 has relief form 38. Above relief form 38 is thin palladium layer 39 that has arisen by photolytic decomposition of the palladium acetate film. The unexposed areas of this film have been removed in unit 24. Metal 2 has been deposited over palladium layer 39. It has exactly the contour shapes of pailadium layer 39 and is a true representation of relief form 38.

Simultaneous transfer of metalization and relief form avoids losses of quality that arise from subsequent application of the metalization because the subsequently deposited metal layer blurs the relief forms. It simultaneously avoids the adverse influence of the surface structure of the substrate because the layer of lacquer compensates the roughness of the base.

The measures known from EP-A 0 440 045 for glazing the base in the area of the subsequently applied hologram can of course nevertheless be performed if this should be necessary under special circumstances, e.g. because particularly thin layers of lacquer are to be used for certain reasons.

As already explained, photolytic metalization of the matrix offers the possibility of producing finely structured metallic surfaces. This fact is of great advantage particularly when designing holograms in combination with other features. For example the hologram can be provided with a line or guilloche frame or screened on so that a background print remains visible. It is also conceivable to provide recesses in the metalization in the form of characters or patterns. Due to the variable possibilities of exposing the palladium acetate film one could also provide continuous numbering on the hologram in the form of metallic numbers.

In contrast to the customary requirement in technology that metal coatings should adhere as well as possible, the invention requires detachable adhesion of the metal layer to the master surface.

This is a lesser problem than producing good adhesion. While few materials adhere well to each other and most require additional measures (such as roughening of the surface), poor adhesion is normal for coatings and can be easily obtained if one heeds the following.

The "master" surface form must have no "undercuts," "hollows" or "overhangs" but only simple "hills" and "valleys." This is given with smooth surfaces or hologram reliefs.

The "master" substance and the metalizing substance must not be too closely related chemically, e.g. copper on brass is unsuitable for producing a detachable connection, but copper on aluminum or on many plastics is suitable.

By adapting the layer thickness and the degree of activation of the precursor during photolytic metalization one can adjust the detachability of the metal layer.

By varying the current intensity and thus the rate of deposition one can adjust the adhesion of the layer during electrolytic coating. Fast deposition results in a detachable layer.

When depositing a metal layer one obtains a detachable layer by previously applying a monomolecular layer of a parting agent, unless one prefers to make the master mold directly from a substance offering poor adhesion for the metal layer.

The statements at the outset show that the range of variation is far from exhausted by the stated examples. The inventive method basically involves a few functional blocks which in turn offer some very different variants. Variation presents itself in particular in the selection of the intermediate carrier (cylindrical press roll, endless band, die), the form (high-gloss, macrostructure, microstructure, hologram, diffraction grid, etc.), the metalization method, the type of local limitation (limited metal layer on master or limited adhesive layer), the placement of the adhesive (on metal layer or substrate), the adhesive and corresponding hardening method, the additional steps for stabilization, etc.

A further basic variant is to forgo the substrate. In this example the lacquer is hardened directly on the metallic intermediate carrier and removed with the metal layer as a self-supporting film.

As only some of the possible combinations have been shown in the examples described, they do not involve a final selection. Further combinations falling within the general inventive idea are likewise included in the scope of protection.

What is claimed is:

1. A method for producing a metal layer having a defined surface structure on a substrate, wherein the metal layer is prepared on an intermediate carrier in detachable form and then transferred to the substrate comprising the following steps:

a) providing directly on a surface of an intermediate carrier a master form to be transferred, b) depositing a metal layer by metallization directly on the master form of the intermediate carrier so the metal layer conforms precisely to the master form, c) coating the metal layer with a layer of lacquer, d) hardening the layer of lacquer, and e) separating the intermediate carrier from the assembly of metal layer and hardened layer of lacquer, wherein the hardened lacquer layer constitutes the substrate.

2. A method for producing a metal layer having a defined surface form on a substrate, wherein the metal layer is prepared on an intermediate carrier in detachable form and then transferred to the substrate comprising the following steps:

a) providing directly on the surface of an endless circulating band intermediate carrier a master form to be transferred, b) depositing a free metal layer directly on the master form of the intermediate carrier by metallization so the free metal layer conforms precisely to the master form, c) coating a substrate or the metal layer with a layer of lacquer, d) bringing together the metal layer, layer of lacquer and substrate while the layer of lacquer is soft and sticky, e) hardening the layer of lacquer while the metal layer and the substrate are in contact with the layer of lacquer, and f) separating the intermediate carrier from the assembly of the metal layer, the layer of lacquer and the substrate.

3. The method of claims 1 or 2, wherein the master form is an extremely smooth surface.

4. The method of claim 1 or 2, wherein the master form is a surface relief in the form of a diffraction form.

5. The method of claim 1 or 2, wherein the metal layer is produced by a process selected from the group consisting of photolysis, electrolysis, gas jet deposition, spray deposition and laser deposition.

6. The method of claim 1 or 2, wherein the layer of lacquer is hardened by a process selected from the group consisting of change of temperature UV radiation, microwave radiation and electron radiation.

7. The method of claim 2, wherein the lacquer is coated on the substrate and the substrate is glazed prior to coating the substrate with lacquer.

8. The method of claim 2, wherein the substrate is further subjected to an after-treatment after the metal layer is transferred.

9. The method of claim 8, wherein the substrate is coated with a protective lacquer in the area of the metal layer.

10. The method of claims 8 or 9, wherein the substrate is printed with a blind stamp in the area of the metal layer.

11. The method of claim 1, wherein the master form is produced on apparatus selected from the group consisting of a cylindrical press roll, a letterpress cylinder, a die and an endless band.

12. The method of claim 3, wherein the metal layer is produced by a process selected from the group consisting of photolysis, electrolysis, gas jet deposition, spray deposition and laser deposition.

13. The method of claim 4, wherein the metal layer is produced by a process selected from the group consisting of photolysis, electrolysis, gas jet deposition, spray deposition and laser deposition.

14. The method of claim 3, wherein the layer of lacquer is hardened by a process selected from the group consisting of change of temperature, UV radiation, microwave radiation and electron radiation.

15. The method of claim 4, wherein the layer of lacquer is hardened by a process selected from the group consisting of a change of temperature, UV radiation, microwave radiation and electron radiation.

16. The method of claim 5, wherein the layer of lacquer is hardened by a process selected from the group consisting of a change of temperature, UV radiation, microwave radiation and electron radiation.

17. The method of claim 3, wherein the substrate is glazed prior to coating the substrate with lacquer.

18. The method of claim 4, wherein the substrate is glazed prior to coating the substrate with lacquer.

19. The method of claim 5 wherein the substrate is glazed prior to coating the substrate with lacquer.

20. The method of claim 6, wherein the substrate is glazed prior to coating the substrate with lacquer.

21. The method of claim 3, wherein the substrate is further subjected to an after-treatment after the metal layers are transferred.

22. The method of claim 4, wherein the substrate is further subjected to an after-treatment after the metal layer is transferred.

23. The method of claim 5, wherein the substrate is further subjected to an after-treatment after the metal layer is transferred.

24. The method of claim 6, wherein the substrate is further subjected to an after-treatment after the metal layers are transferred.

25. The method of claim 7, wherein the substrate is further subjected to an after-treatment after the metal layers are transferred.

26. The method of claim 21, wherein the substrate is coated with a protective lacquer in the area of the metal layer.

27. The method of claim 22, wherein the substrate is coated with a protective lacquer in the area of the metal layer.

28. The method of claim 23, wherein the substrate is coated with a protective lacquer in the area of the metal layer.

29. The method of claim 24, wherein the substrate is coated with a protective lacquer in the area of the metal layer.

30. The method of claim 25, wherein the substrate is coated with a protective lacquer in the area of the metal layer.

31. The method of claim 21, wherein the substrate is printed with a blind stamp in the area of the metal layer.

32. The method of claim 22, wherein the substrate is printed with a blind stamp in the area of the metal layer.

33. The method of claim 23, wherein the substrate is printed with a blind stamp in the area of the metal layer.

34. The method of claim 24, wherein the substrate is printed with a blind stamp in the area of the metal layer.

35. The method of claims 25 or 30, wherein the substrate is printed with a blind stamp in the area of the metal layer.

36. The method of claim 3 or 1, wherein the master form is produced on apparatus selected from the group consisting of a cylindrical press roll, a letterpress cylinder, a die and an endless band.

37. The method of claim 4 or 1, wherein the master form is produced on apparatus selected from the group consisting of a cylindrical press roll, a letterpress cylinder, a die and an endless band.

38. The method of claim 5 or 1, wherein the master form is produced on apparatus selected from the group consisting of a cylindrical press roll, a letterpress cylinder, a die and an endless band.

39. The method of claim 6 or 1, wherein the master form is produced on apparatus selected from the group consisting of a cylindrical press roll, a letterpress cylinder, a die and an endless band.

40. The method of claim 26, wherein the substrate is printed with a blind stamp in the area of the metal layer.

41. The method of claim 27, wherein the substrate is printed with a blind stamp in the area of the metal layer.

42. The method of claim 28, wherein the substrate is printed with a blind stamp in the area of the metal layer.

43. The method of claim 29, wherein the substrate is printed with a blind stamp in the area of the metal layer.

44. The method of claim 1, wherein the metal layer is disposed in a locally limited form.

45. The method of claim 2, wherein the metal layer is disposed in a locally limited form.

* * * * *